US008971542B2

(12) United States Patent
Lau et al.

(10) Patent No.: US 8,971,542 B2
(45) Date of Patent: Mar. 3, 2015

(54) SYSTEMS AND METHODS FOR SPEAKER BAR SOUND ENHANCEMENT

(75) Inventors: Harry K. Lau, Norwalk, CA (US); Yair Kerner, Kiryat Ono, IL (US); Jonathan Chien, Tustin, CA (US); James W. Wihardja, Fullerton, CA (US)

(73) Assignee: Conexant Systems, Inc., Irvine, CA (US)

( * ) Notice: Subject to any disclaimer, the term of this patent is extended or adjusted under 35 U.S.C. 154(b) by 919 days.

(21) Appl. No.: 13/092,006

(22) Filed: Apr. 21, 2011

(65) Prior Publication Data

US 2011/0200195 A1 Aug. 18, 2011

Related U.S. Application Data

(63) Continuation-in-part of application No. 12/963,443, filed on Dec. 8, 2010, which is a continuation-in-part of application No. 12/814,425, filed on Jun. 11, 2010, now Pat. No. 8,577,065.

(60) Provisional application No. 61/186,795, filed on Jun. 12, 2009.

(51) Int. Cl.

| | |
|---|---|
| ***H04R 5/00*** | (2006.01) |
| ***H04S 7/00*** | (2006.01) |
| ***H04S 3/00*** | (2006.01) |

(52) U.S. Cl.

CPC . *H04S 7/30* (2013.01); *H04S 3/002* (2013.01); *H04S 2400/01* (2013.01)

USPC ..... 381/17; 381/1; 381/61; 381/300; 381/310

(58) Field of Classification Search

CPC ..... H04S 3/002; H04S 7/30; H04S 2400/01; H04S 2420/01; H04S 5/00; H04S 7/302; H04R 5/02; H04R 3/04; H04R 3/12; H04R 1/403; H04R 2499/15; H04R 5/00; H04R 2430/20

USPC ..... 381/17, 1, 61, 97, 98, 300, 310

See application file for complete search history.

(56) References Cited

U.S. PATENT DOCUMENTS

| | | | | |
|---|---|---|---|---|
| 6,363,155 | B1 * | 3/2002 | Horbach | 381/17 |
| 2008/0101620 | A1 * | 5/2008 | Horbach et al. | 381/59 |

OTHER PUBLICATIONS

Taiwan Patent Office; Response to Office Action; Taiwan Application No. 099144830; Oct. 25, 2013.

European Patent Office; International Preliminary Report on Patentability; PCT Application No. PCT/US2010/061827; Oct. 2, 2012.

Taiwan Patent Office; Office Action; Taiwan Application No. 099144830; Mar. 7, 2014.

Taiwan Patent Office; Office Action (English translation); Taiwan Application No. 099144830; Mar. 7, 2014.

* cited by examiner

*Primary Examiner* — Paul S Kim

(74) *Attorney, Agent, or Firm* — Haynes and Boone, LLP

(57) ABSTRACT

A sound reproduction apparatus comprising a loudspeaker bar having a plurality of loudspeakers. A loudspeaker bar controller coupled to the loudspeaker bar for processing audio data for the plurality of loudspeakers, the loudspeaker bar controller comprising a spatial enhancement/virtualization system for receiving a surround channel of audio data and processing the surround channel of audio data with a spatial generation/virtualization filter, wherein a left stereo channel of audio data and a right stereo channel of audio data are not processed with the head related transfer function filter. Bass is enhanced for small speakers which are not able to produce bass frequencies.

20 Claims, 6 Drawing Sheets

700

706
702
710
704
708
$L_S(T)$
$L(t)$
$R(T)$
$R_S(T)$
714
716
718
720
722
724
726
728
D
712
DIGITAL FILTER
730
732
734
736
746
748
750
752
738
740
742
744
754
756
758
760
$L_{S\text{-}OUT}(T)$
$L_{OUT}(T)$
$R_{OUT}(T)$
$R_{S\text{-}OUT}(T)$
762
764
766
768

SYSTEMS AND METHODS FOR SPEAKER BAR SOUND ENHANCEMENT

RELATED APPLICATIONS

This application claims priority under 35 U.S.C. §§119 and 120 to U.S. Patent Application No. 61/186,795, filed Jun. 12, 2009, entitled "Systems and Methods for Creating Immersion Surround Sound and Virtual Speakers Effects," and is a continuation-in-part of U.S. application Ser. No. 12/814,425, "Systems And Methods For Creating Immersion Surround Sound And Virtual Speakers Effects," which are commonly owned with the pending application and which are hereby incorporated by reference for all purposes, and is a continuation-in-part of U.S. application Ser. No. 12/963,443, "System and Method for Reducing Rub and Buzz Distortion," filed Dec. 8, 2010, which is commonly owned with the pending application and which is hereby incorporated by reference for all purposes.

TECHNICAL FIELD

The present invention relates generally to stereo audio reproduction and specifically to personal computer speaker bar sound enhancement.

BACKGROUND OF THE INVENTION

Consumers use a surround sound speaker system in a room or other large space to play back multi-channel sound, such as for movies and music. Because of space constraints, other sound systems such as ones for portable electronics use speaker bar instead. Laptop computers also typically have embedded speakers in a speaker bar with tiny speakers. Such a speaker bar has a small form factor and often cannot produce a surround sound effect. Small speakers also cannot produce enough bass energy to make the sound for movies and music satisfying to a listener. The inexpensive speakers used in such portable electronics also have uneven frequency response and distortions. As a result, multi-channel sound played over portable electronics often has poor sound quality.

BRIEF SUMMARY OF INVENTION

In one of many exemplary embodiments of the invention disclosed herein, a sound reproduction apparatus, such as a laptop computer having a set of loudspeakers incorporated within the laptop, is provided. A controller is connected to the set of loudspeakers, and processes audio data for the set of loudspeakers, such as stereo data that is to be converted into surround sound data. The controller includes a spatial enhancement system for receiving a surround channel of audio data and processing the surround channel of audio data with a head related transfer function filter, wherein a left stereo channel of audio data and a right stereo channel of audio data are not processed with the head related transfer function filter.

For small speakers that are not capable to produce bass frequencies, bass is enhanced by using a harmonics generator. The harmonics levels are equalized with frequency response of each individual speaker.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWING

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE INVENTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure.

Figure 1A:
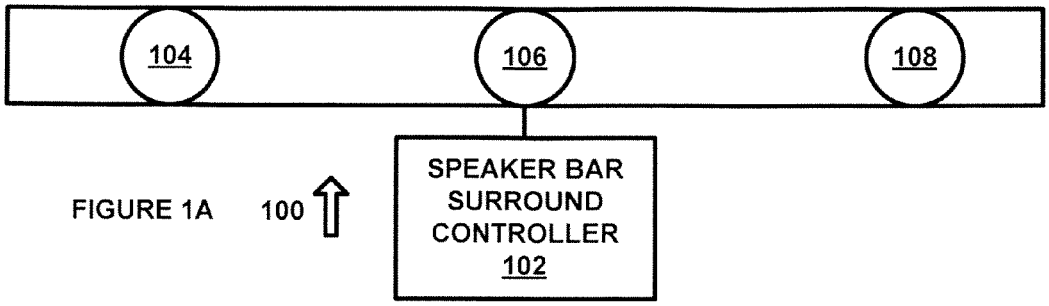
FIG. 1A is a diagram of a system for providing a speaker bar controller in accordance with an exemplary embodiment of the present invention.

FIG. 1A is a diagram of a system 100 for providing a speaker bar controller in accordance with an exemplary embodiment of the present invention. System 100 includes speaker bar controller 102, which can be implemented in hardware or a suitable combination of hardware and software, and which can be one or more software systems operating on a general purpose processor. As used herein and by way of example and not by limitation, "hardware" can include a combination of discrete components, an integrated circuit, an application-specific integrated circuit, a field programmable gate array, a general purpose processing or server platform, or other suitable hardware. As used herein and by way of example and not by limitation, "software" can include one or more objects, agents, threads, lines of code, subroutines, separate software applications, one or more lines of code or other suitable software structures operating in one or more software applications or on one or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

Speaker bar controller 102 is used to drive left speaker 104, right speaker 108 and center speaker 106. In one exemplary embodiment, speaker bar controller 102 is configured based on the dimensions and locations of a sound bar containing left speaker 104, right speaker 108 and center speaker 106, and an expected location of a user of a personal computer or laptop computer that incorporates the sound bar, such as by using the dimensions to calculate correction factors for audio processing, as described in greater detail herein. The dimensions of the speaker locations can be stored in speaker bar controller 102 at the factory, and speaker bar controller 102 can detect a location of a user or receive a user input for the location of the user relative to the speaker bar. The speaker parameters can also be measured at the factory, such as to develop a speaker frequency response model for each speaker, each speaker as installed in the sound bar, or other suitable frequency response models. These frequency response models can also or alternatively be stored in speaker bar controller 102 at the factory, and used to provide enhanced speaker sound as described herein.

Figure 1B:
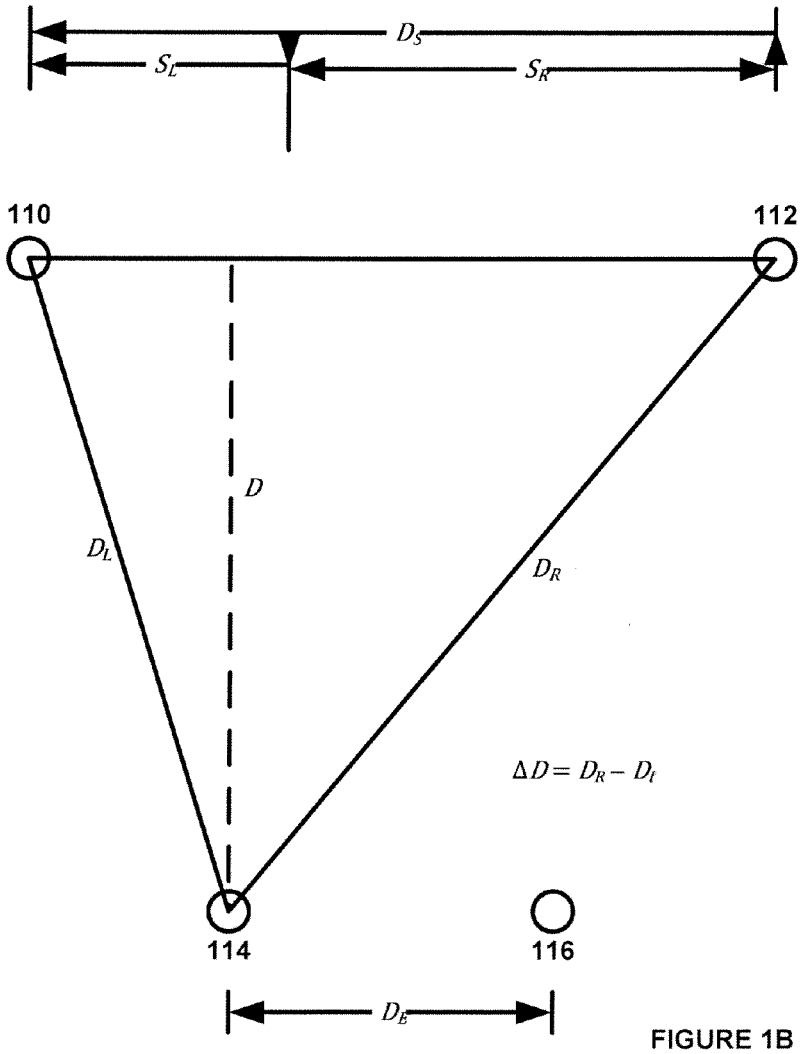
FIG. 1B is a diagram of dimensions that can be used to calculate a desired delay $\Delta T$ in accordance with an exemplary embodiment of the present invention.

FIG. 1B is a diagram of dimensions that can be used to calculate a desired delay ΔT in accordance with an exemplary embodiment of the present invention. The delay ΔT is determined based on the distance between the ears of a user and each speaker of a sound bar. The diagram of FIG. 1B is applicable to the calculation of a delay with respect to left ear 114 relative to locations of a left speaker 110 and a right speaker 112, but could also or alternatively be applied to right ear 116 and additional speakers, such as a left outer speaker and a right outer speaker.

The difference in distance between left ear 114 and left speaker 110 is given by $D_L$ and the distance between left ear 114 and right speaker 112 is given by $D_R$. These distances define two triangles, with the third side represented by the distances $s_L$ and $s_R$, respectively. If an assumption is made that the listener is centered between the speakers then $S_L=(D_S-D_E)/2$ and $S_R=(D_S+D_E)/2$. Using the Pythagorean theorem, the difference between the distances $\Delta D=0.5(((D_S+D_E)^{1/2}+4D^2)^{1/2}-((D_S-D_E)^{1/2}+4D^2)^{1/2})$. The desired delay can be calculated from ΔD by multiplying ΔD by the speed of sound.

In one exemplary embodiment, the distance between human ears $D_E$ is assumed to be approximately 6 inches. For notebook computers, the distance between speakers $D_S$ typically ranges between 6 inches to 15 inches, depending on the configuration. The distance an average person sits from their notebook computers $D_S$ is assumed to be between 12 to 36 inches in the present embodiment. For other electronic devices, such as a portable DVD player, the distances between the individual speakers and the speakers to the user may be smaller. Exemplary input and output values are shown in Table 1. Given the above assumptions, delays fall between the range of 2 to 11 samples when using 48 kHz sampling rate. For higher sampling rates, such as 96 kHz and 192 kHz, the delay expressed in terms of samples increases proportionally with sampling rate. For example in the last case in Table 1 for 192 kHz, the delay is scaled to 11*192/48=44 samples.

TABLE 1

| $d_s$ (in) | d (in) | Δd (in) | Δτ (ms) | Samples @ 44.1 kHz | Samples @ 48 kHz |
|---|---|---|---|---|---|
| 6 | 36 | 0.50 | 0.04 | 2 | 2 |
| 9 | 30 | 0.89 | 0.07 | 3 | 3 |
| 10 | 26 | 1.13 | 0.08 | | 4 |
| 12 | 24 | 1.45 | 0.11 | 5 | 5 |
| 8 | 15 | 1.52 | 0.11 | 5 | 5 |
| 14 | 22 | 1.81 | 0.13 | 6 | 6 |
| 15 | 12 | 3.13 | 0.23 | 10 | 11 |

Figure 2:
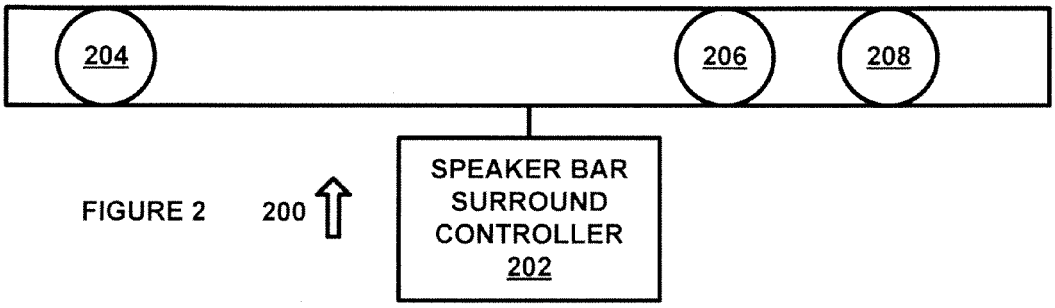
FIG. 2 is a diagram of a system for providing a speaker bar controller in accordance with an exemplary embodiment of the present invention.

FIG. 2 is a diagram of a system 200 for providing a speaker bar controller in accordance with an exemplary embodiment of the present invention. System 200 includes speaker bar controller 202, which can be implemented in hardware or a suitable combination of hardware and software, and which can be one or more software systems operating on a general purpose processor.

Speaker bar controller 202 is used to drive left speaker 204, right speaker 208 and center speaker 206. In one exemplary embodiment, speaker bar controller 202 is configured based on the dimensions and locations of a sound bar containing left speaker 204, right speaker 208 and center speaker 206 (which are different from the speakers of system 100 in that left speaker 204 and right speaker 208 are offset and asymmetric, and center speaker 206 is also offset), and an expected location of a user of a personal computer or laptop computer that incorporates the sound bar, such as by using the dimensions to calculate correction factors for audio processing, as described in greater detail above. The dimensions of the speaker locations can be stored in speaker bar controller 202 at the factory, and speaker bar controller 202 can detect a location of a user or receive a user input for the location of the user relative to the speaker bar. The speaker parameters can also be measured at the factory, such as to develop a speaker frequency response model for each speaker, each speaker as installed in the sound bar, or other suitable frequency response models. These frequency response models can also or alternatively be stored in speaker bar controller 202 at the factory, and used to provide enhanced speaker sound as described herein.

Figure 3:
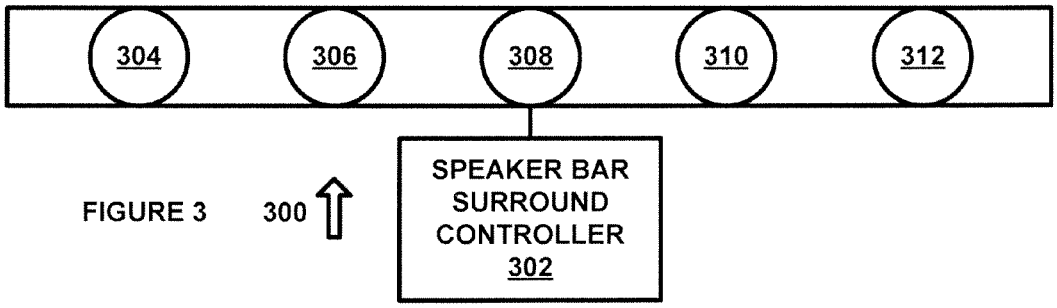
FIG. 3 is a diagram of a system for providing a speaker bar controller in accordance with an exemplary embodiment of the present invention.

FIG. 3 is a diagram of a system 300 for providing a speaker bar controller in accordance with an exemplary embodiment of the present invention. System 300 includes speaker bar controller 302, which can be implemented in hardware or a suitable combination of hardware and software, and which can be one or more software systems operating on a general purpose processor.

Speaker bar controller 202 is used to drive left outer speaker 304, left speaker 306, center speaker 308, right speaker 310 and right outer speaker 312. In one exemplary embodiment, speaker bar controller 302 is configured based on the dimensions and locations of a sound bar containing these speakers, and an expected location of a user of a personal computer or laptop computer that incorporates the sound bar, such as by using the dimensions to calculate correction factors for audio processing, as described in greater detail above. The dimensions of the speaker locations can be stored in speaker bar controller 302 at the factory, and speaker bar controller 302 can detect a location of a user or receive a user input for the location of the user relative to the speaker bar. The speaker parameters can also be measured at the factory, such as to develop a speaker frequency response model for each speaker, each speaker as installed in the sound bar, or other suitable frequency response models. These frequency response models can also or alternatively be stored in speaker bar controller 302 at the factory, and used to provide enhanced speaker sound as described herein.

Figure 4:
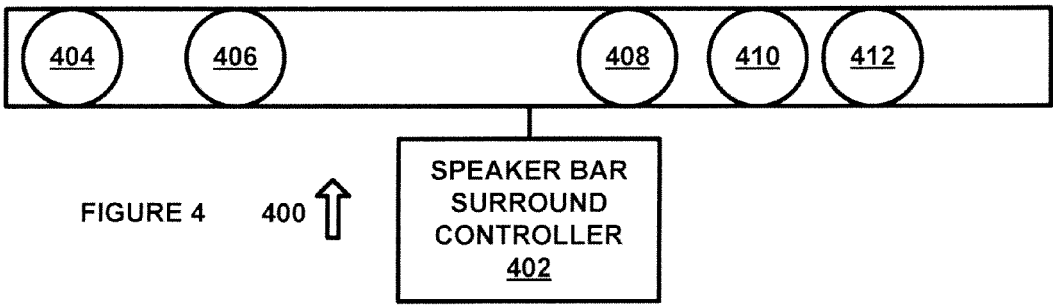
FIG. 4 is a diagram of a system for providing a speaker bar controller in accordance with an exemplary embodiment of the present invention.

FIG. 4 is a diagram of a system 400 for providing a speaker bar controller in accordance with an exemplary embodiment of the present invention. System 400 includes speaker bar controller 402, which can be implemented in hardware or a suitable combination of hardware and software, and which can be one or more software systems operating on a general purpose processor.

Speaker bar controller 402 is used to drive left outer speaker 404, left speaker 406, center speaker 408, right speaker 410 and right outer speaker 412. In one exemplary embodiment, speaker bar controller 202 is configured based on the dimensions and locations of a sound bar containing left outer speaker 404, left speaker 406, center speaker 408, right speaker 410 and right outer speaker 412 (which are different from the speakers of system 300 in that left outer speaker 404, left speaker 406, right speaker 410 and right outer speaker 412 are offset and asymmetric, and center speaker 408 is also offset), and an expected location of a user of a personal computer or laptop computer that incorporates the sound bar, such as by using the dimensions to calculate correction factors for audio processing, as described in greater detail above. The dimensions of the speaker locations can be stored in speaker bar controller 402 at the factory, and speaker bar controller 402 can detect a location of a user or receive a user input for the location of the user relative to the sneaker bar. The speaker parameters can also be measured at the factory, such as to develop a speaker frequency response model for each speaker, each speaker as installed in the sound bar, or other suitable frequency response models. These frequency response models can also or alternatively be stored in speaker bar controller 402 at the factory, and used to provide enhanced speaker sound as described herein.

Figure 5:
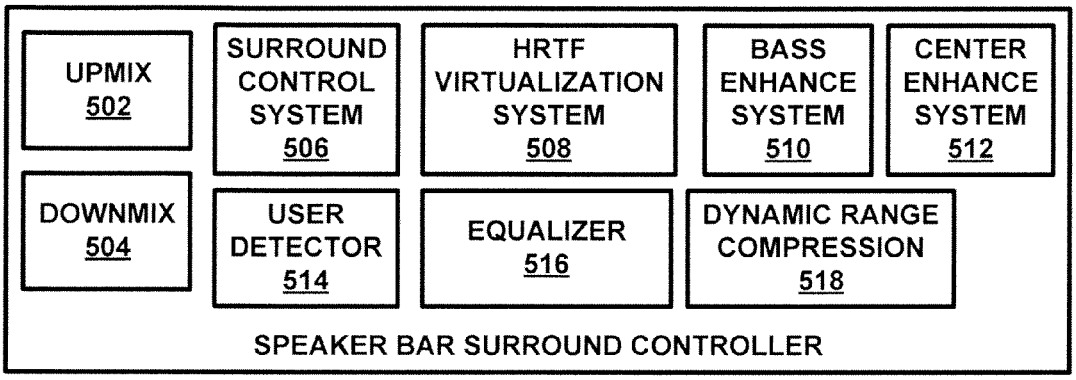
FIG. 5 is a diagram of a speaker bar controller in accordance with an exemplary embodiment of the present invention.

FIG. 5 is a diagram of a speaker bar controller 500 in accordance with an exemplary embodiment of the present invention. Speaker bar controller 500 includes upmix 502, downmix 504, surround system 506, HRTF virtualization system 508, bass enhance system 510, center enhance system 512, user detector 514, equalizer 516 and dynamic range compression 518, each of which can be implemented in hardware, software or a suitable combination of hardware and software, and which can be one or more software systems operating on a general purpose processing platform.

Upmix 502 and downmix 504 are used to convert a received audio signal into an audio signal that matches a system speaker configuration. In one exemplary embodiment, speaker bar controller 500 can be used in conjunction with a laptop or other personal computer, which can receive audio data in a format that does not match the native speaker configuration. Upmix 502 can be used to convert the received audio data into more channels where necessary (such as from received 2.0 or 3.1 audio data to a 3.1 or 5.1 native format, respectively), and downmix 504 can be used to convert the received audio data into less channels where necessary (such as from received 9.1 or 7.1 audio data to a 5.1 or 3.1 native format).

Surround system 506 can process received audio data to convert it into a virtualized surround format. In one exemplary embodiment, received audio data can be processed to improve the surround sound quality of the audio data when it is played using the native sound bar speaker configuration. In this exemplary embodiment, the audio data can be received in a surround format, such as 5.1, and can be downmixed to be played in the surround format using the native speakers, such as a 3.0 format. Likewise, the audio data can be received in a stereo (2.0) format and upmixed to be played in a surround format using the native speakers, such as a 3.0 format.

HRTF virtualization system 508 utilizes head-related transfer function filters to add sound field depth. In one exemplary embodiment, left and right head related transfer function filters can be applied and cross-correlated to each sound channel to add sound field depth.

Bass enhance system 510 applies bass enhancement algorithms as a function of the frequency response of the speaker bass frequency response. For speakers having poor bass response, one solution is to replace the bass frequency by harmonics with frequencies that are integer multiple of the original frequency, but this process creates a number of problems, including an uneven frequency response of the speaker at the harmonics frequencies. This produce inaccurate level of bass harmonics. In one exemplary embodiment, the frequency response of each speaker can be determined, such as by using the process described in U.S. application Ser. No. 12/963,443, "System and Method for Reducing Rub and Buzz Distortion," filed Dec. 8, 2010, which is commonly owned with the pending application and which is hereby incorporated by reference for all purposes. Harmonics are equalized according to the inverse of the frequency response measurements. For loudspeakers that are not capable of producing some bass frequencies, it is preferable to use a bass reinforcement method which leaves the original bass content. For loudspeakers that are unable to produce bass frequencies at all, it is preferable to use a bass replacement method, which cuts the original bass content off. In one exemplary embodiment, the frequency response for each speaker can be different, such as where a first harmonic is selected for bass enhancement of a bass frequency for a first speaker, and a second harmonic is selected for bass enhancement of that bass frequency for a second speaker.

Center enhance system 512 allows the center image to be enhanced where the speaker bar speakers are not symmetric. In one exemplary embodiment, the center channel audio data can be simulated in a two or four speaker sound bar system by playing the center channel audio data through each speaker. Where the speakers are not symmetric, the amplitude and phase associated with the center channel audio data may need to be modified to compensate for the speaker offsets. Center enhance system 512 compensates the audio data based on the native speaker configuration.

To let listeners hear better on dialogues which are often low in volume in movies, a mixer is used to mix a portion of the surround channels and the left and right channel sound to the center speaker. Also another mixer is used to mix a part of the center channel sound to outer speakers or left and right speakers.

User detector 514 detects the relative distance between a user and the speaker bar. In one exemplary embodiment, a proximity sensor such as a audio or video ranging system can be used to determine how far away a user is to the speaker bar, so as to automatically adjust delay values and other variables that are used to improve the sound field, as discussed further herein.

Equalizer 516 provides frequency band equalization for channels of audio data. In one exemplary embodiment, equalizer 516 can be used to provide equalization based on expected operating environments, to correct for speaker or enclosure dynamic response, or to provide other suitable equalization.

Dynamic range compression 518 compensates for increased signals peaks that may be added by other components of speaker bar controller 500. Dynamic range compression 518 helps to reduce clipping distortion that may be caused by increased signal peaks. In addition to potentially degrading audio quality, clipping distortion can lead to loss of signal data and spatial virtualization.

In operation, speaker bar controller 500 allows audio content to be optimized for a native speaker configuration of a speaker bar, such as by upmixing or downmixing, surround enhancement processing, HRTF virtualization, bass enhancement that is optimized for the frequency response of the native speakers, center enhancement or a user's relative position. Speaker bar controller 500 can be used to improve the audio data sound field as a function of the speaker bar configuration.

Figure 6:
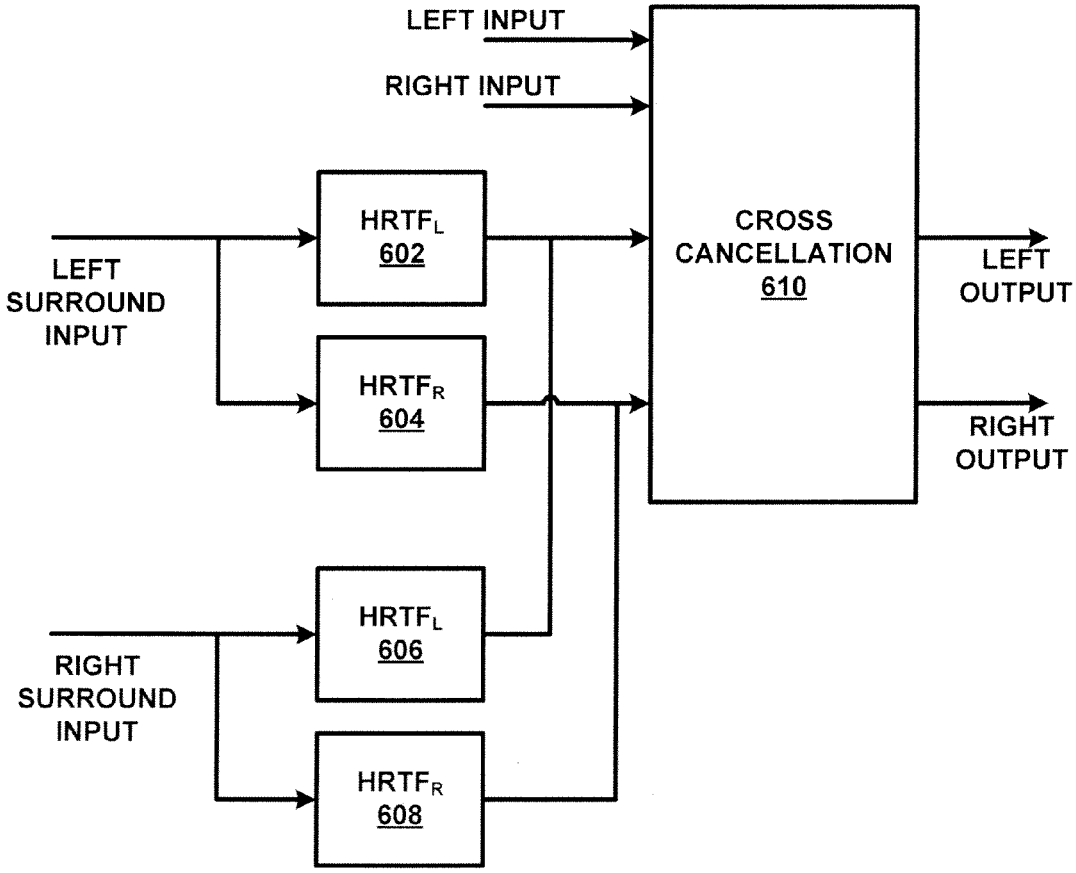
FIG. 6 is a diagram of a head related transfer function virtualization system in accordance with an exemplary embodiment of the present invention.

FIG. 6 is a diagram of a head related transfer function virtualization system 600 in accordance with an exemplary embodiment of the present invention. Head related transfer function virtualization system 600 can be implemented in hardware or a suitable combination of hardware and software, and can be one or more software systems operating on a digital signal processing platform or other suitable processors.

Head related transfer function virtualization system 600 includes left head related transfer function filters 602 and 606 and right head related transfer function filters 604 and 608, which receive left surround input and right surround input, respectively. The output from the filters is then provided to cross cancellation and mixing 610, which performs cross cancellation of the filtered surround inputs and which also mixes the surround inputs with the left and right channel audio inputs to generate left and right audio output. Applying the head related transfer function filters to the surround audio channel data and not to the front audio channel data provides additional definition in the sound field for the surround channel audio data.

In operation, head related transfer function virtualization system 600 can be used to provide additional sound field definition for surround audio channel data, by applying a head related transfer function filter to the surround channel audio data.

Figure 7:
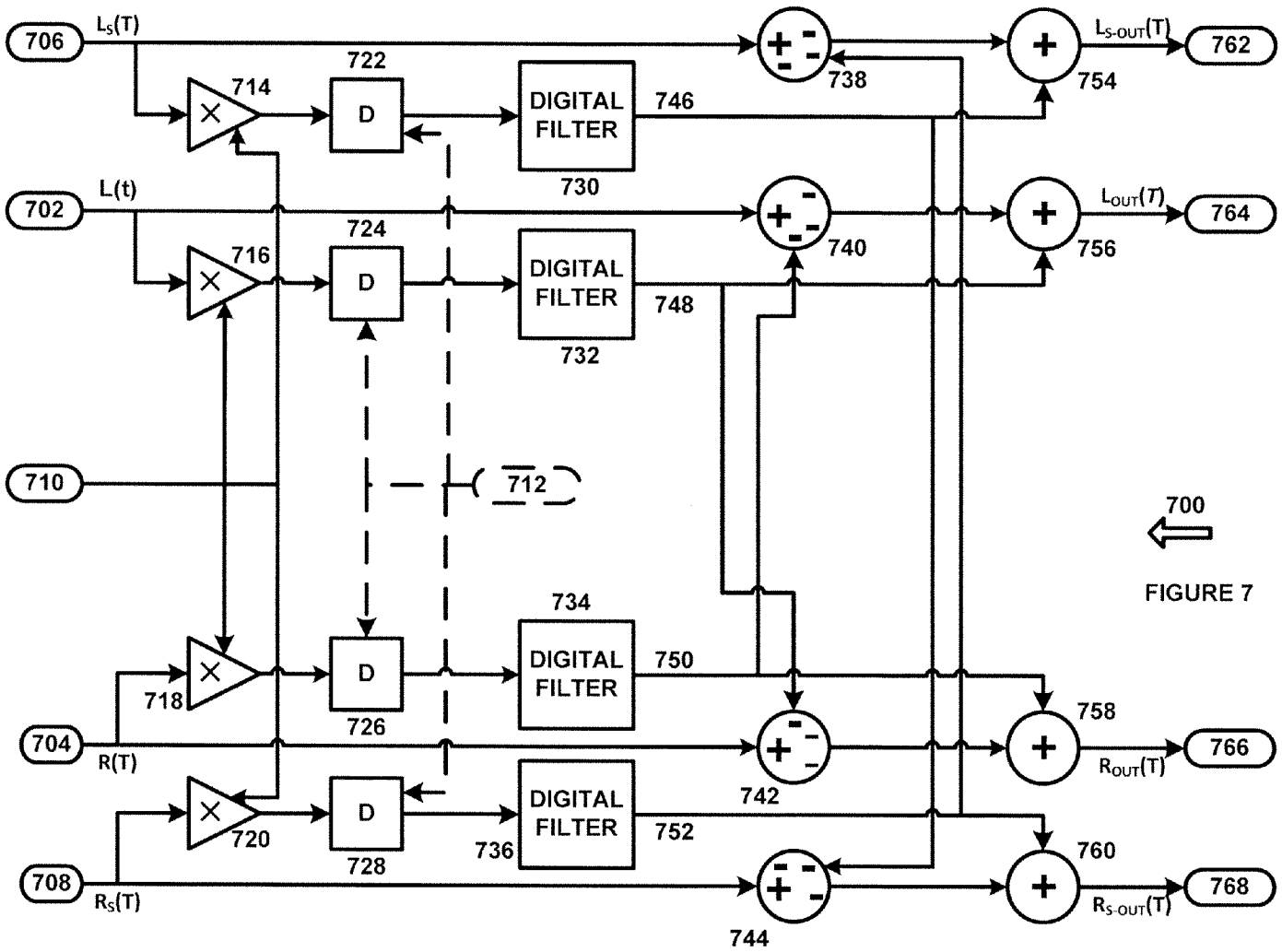
FIG. 7 is a diagram of a speaker virtualization system for generating a sound field with greater spatial separation in accordance with an exemplary embodiment of the present invention.

FIG. 7 is a diagram of a speaker virtualization system 700 for generating a sound field with greater spatial separation in accordance with an exemplary embodiment of the present invention. Speaker virtualization system 700 can be implemented in hardware or a suitable combination of hardware and software, and can be one or more software systems operating on a digital signal processing platform or other suitable processors.

Speaker virtualization system 700 receives left channel input signal 702, left surround channel input signal 706, right channel input signal 704 and right surround channel input signal 708, and outputs left channel output signal 764, left surround channel output signal 762, right channel output signal 766 and right surround channel output signal 768. Spread value 710 is also received by speaker virtualization system 700. Spread control 710 controls the intensity of the widening effect.

A copy of the left channel input signal 702 is scaled by spread value 710 using multiplier 716, and is then delayed by delay element 724 and filtered by digital filter 732. Likewise, a copy of the right channel signal 704 is scaled by spread value 710 using multiplier 716, and is then delayed by delay element 726 and filtered by digital filter 734. The surround channels 706 and 708 are also processed in the same manner by multipliers 714 and 720, respectively, and delay elements 722 and 728, respectively.

The left channel signal output processed by digital filter 732 is shown as signal 748, and is subtracted from the right channel by mixer 742, and is added back to the original left channel signal by mixer 756 to generate left channel output signal 764. Similarly, the right channel signal output processed by digital filter 734 is shown as signal 750, and is subtracted from the left channel by mixer 740, and added back to the original right channel by mixer 758 to generate right channel output signal 766. The processed surround channels 746 and 752 are also processed in the same manner by mixer 744, to generate left surround channel output signal 762 and right surround channel output signal 768, respectively.

Mathematically, if left channel input signal 702 is represented by L(t) and right channel input signal 704 is represented by R(t), digital filter 734 transforms R(t) into R'(T) and digital filter 732 transforms L(T) into L'(T), then the resultant left channel signal output by digital filter 732 is S*L'(T−ΔT), where s is the spread value 710 and ΔT is the delay imposed by delay element 724. Similarly, the resultant right channel signal output by digital filter 734 is S*R'(T−ΔT), the resultant left surround channel signal output by digital filter 730 is $S*L_S'(T-\Delta T)$, and the resultant right surround channel signal output by digital filter 736 is $S*R_S'(T-\Delta T)$. Therefore, left channel output signal 764 is defined by the equation:

$$L_{OUT}(T)=L(T)-(S*R'(T-\Delta T)+S*L_S'(T-\Delta T)+S*R_S'(T-\Delta T))+S*L'(T-\Delta T)$$

And the right channel output signal 766, left surround channel output signal 762 and right surround channel output signal 768 are each given by:

$$R_{OUT}(T)=R(T)-(S*L'(T-\Delta T)+S*L_S'(T-\Delta T)+S*R_S'(T-\Delta T))+S*R'(T-\Delta T),$$

$$L_{SOUT}(T)=L_S(T)-(S*R'(T-\Delta T)+S*L'(T-\Delta T)+S*R_S'(T-\Delta T))+S*L_S'(T-\Delta T),$$

and $$R_{SOUT}(T)=R_S(T)-(S*R-(T-\Delta T)+S*L-(T-\Delta T)+S*L_S'(T-\Delta T))+S*R_S'(T-\Delta T)$$

While for simplicity, the equations are expressed as analog signals, the processing can be performed digitally as well on L(n), R(n), $L_S(n)$ and $R_S(n)$ with their digital counterparts.

The spread value 710 influences the strength of a widening effect by controlling the volume of the virtual sound. If the spread value is zero, there is no virtualization, only the original sound. Generally speaking, the larger the spread value, the louder the virtual sound effect. As described in the present embodiment, the virtual sound and cross-cancellation mixed with the original audio data can be used to produce an audio output that would sound like an extra set of speakers outside of the original set of stereo speakers.

An additional feature of speaker virtualization system 700 is in the choice of a predetermined delay value for delay elements 722, 724, 726 and 728. In an audio driver for a notebook computer, the selection of delay value 712 can be important for achieving certain wide spatial effects, as previously discussed. The delay is calculated based on the distance between human ears ($D_E$), the distance between speakers ($D_S$) and the distance between the listener and the speakers (D), although with outside speakers, the delay values may need to be different based on the emphasis desired for the surround channels. For example, the delay between the left surround channel speaker and a listener's left ear will be different for each of the left channel speaker, the right channel speaker and the right surround channel speaker. In some sound system configurations, the placement of the speakers may allow a single delay to be used, such as where the outside speakers are located close to the associated front channels, whereas in other system configurations, additional delays for each channel relative to each other channel can be provided (which is not shown here for clarity). Delay elements 722, 724, 726 and 728 or other delays can be implemented with variable delay units, allowing speaker virtualization system 700 to be configurable to different sound system configurations. As a result, in some embodiments of speaker virtualization system 700, the delay is programmable through the introduction of delay value 712 which can adjust the delay on delay elements 722, 724, 726 and 728.

Another feature of speaker virtualization system 700 is the addition of the processed left channel signal back into the left channel output signal, the addition of the processed right channel signal back into the right channel output signal, the addition of the processed left surround channel signal back into the left surround channel output signal and the addition of the processed right surround channel signal back into the right surround channel output signal. Because simple cross cancellation can result in a loss of center sound and loss of bass, adding the processed channel signals back into the output signal produces a sound without a significant loss of center sound and bass, preserving the sound quality during cross cancellation.

Figure 8:
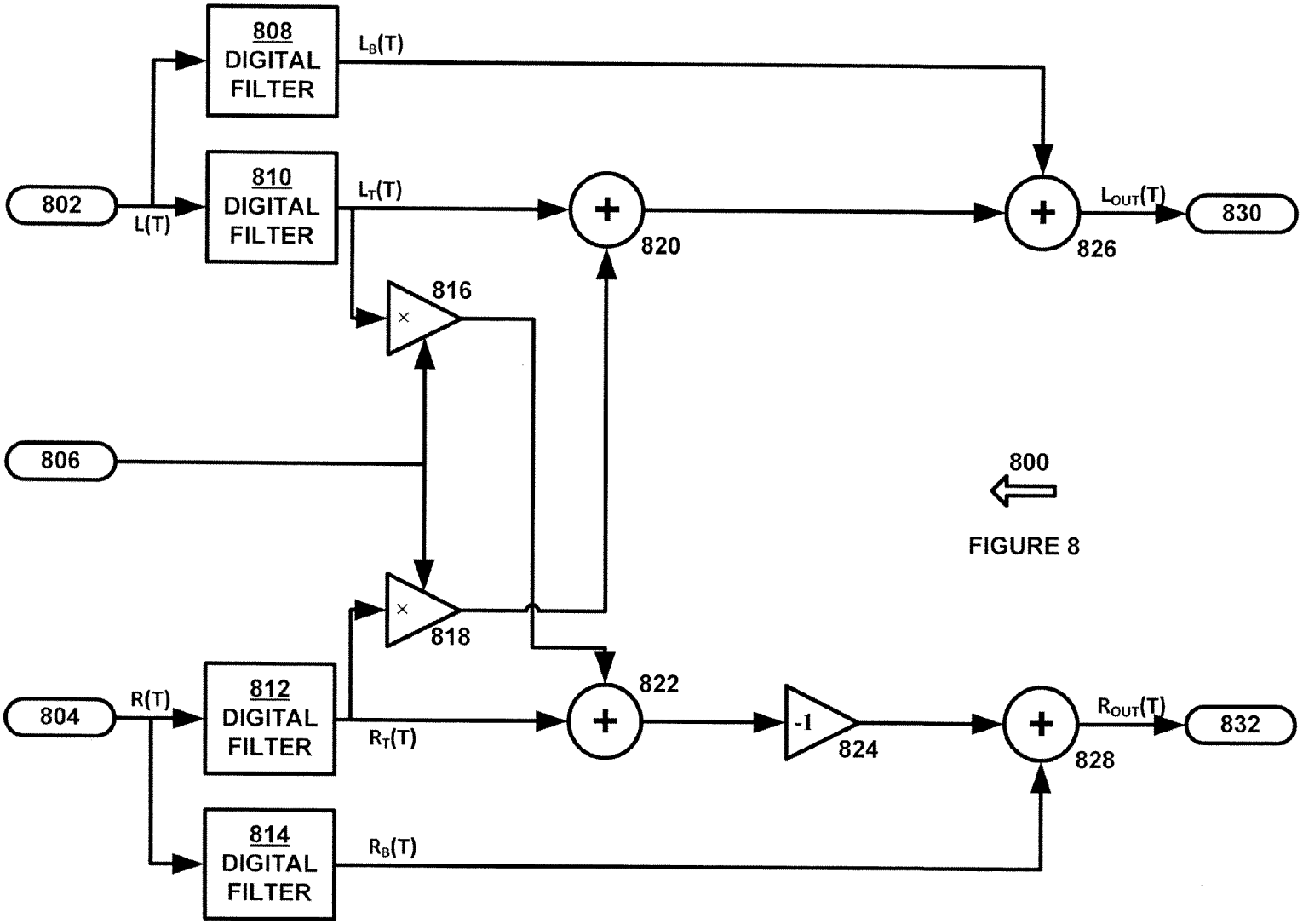
FIG. 8 is a diagram of immersion effect system in accordance with an exemplary embodiment of the present invention.

FIG. 8 is a diagram of immersion effect system 800 in accordance with an exemplary embodiment of the present invention. Immersion effect system 800 can be implemented in hardware or a suitable combination of hardware and software, and can be one or more software systems operating on a digital signal processing platform or other suitable processors.

Immersion effect system 800 can be used to create an immersion effect. Left channel input signal 802, which can be shown mathematically as L(T), is separated into its high frequency components $L_T(T)$ and low frequency components $L_B(T)$, by complementary crossover filters 810 and 808, respectively. Filter 810 allows frequencies above a given crossover frequency to pass whereas filter 808 allows frequencies below the given crossover frequency to pass. Similarly, right channel input signal 804, shown mathematically as R(T), is separated into its high frequency components $R_T(T)$ and low frequency components $R_B(T)$ by complementary crossover filters 812 and 814, respectively. Each signal $L_T(T)$ and $R_T(T)$ is also scaled by spread value 806 using multipliers 816 and 818, respectively, and is added to R(T) and L(T), respectively, by mixers 822 and 820, respectively. The results are added back into the low frequency components by mixers 826 and 828. Left channel output signal 830 can be expressed mathematically as $L_{OUT}(T)=L_B(T)+L_T(T)+S*R_T(T)$, where S represents the spread value. Phase inverter 824 is provided to shift $R_T(T)+L_T(T)$ by essentially 180°, and right channel output signal 832 can be expressed as $R_{OUT}(T)=R_3(T)-R_T(T)-S*L_T(T)$.

The immersion effect is produced when the left ear and right ear respectively perceive two signals that are 180° out of phase. The resulting effect is a sound perceived to be near the listener's ears that appears to diffuse and "jump out" right next to the listener's ears. The use of the spread value in immersion effect system 800 changes the nature of the immersion effect. For example, if the spread value is set to zero, the right channel signal still has the high frequency components phase inverted relative to the input signal, which still yields the immersion effect.

Figure 9:
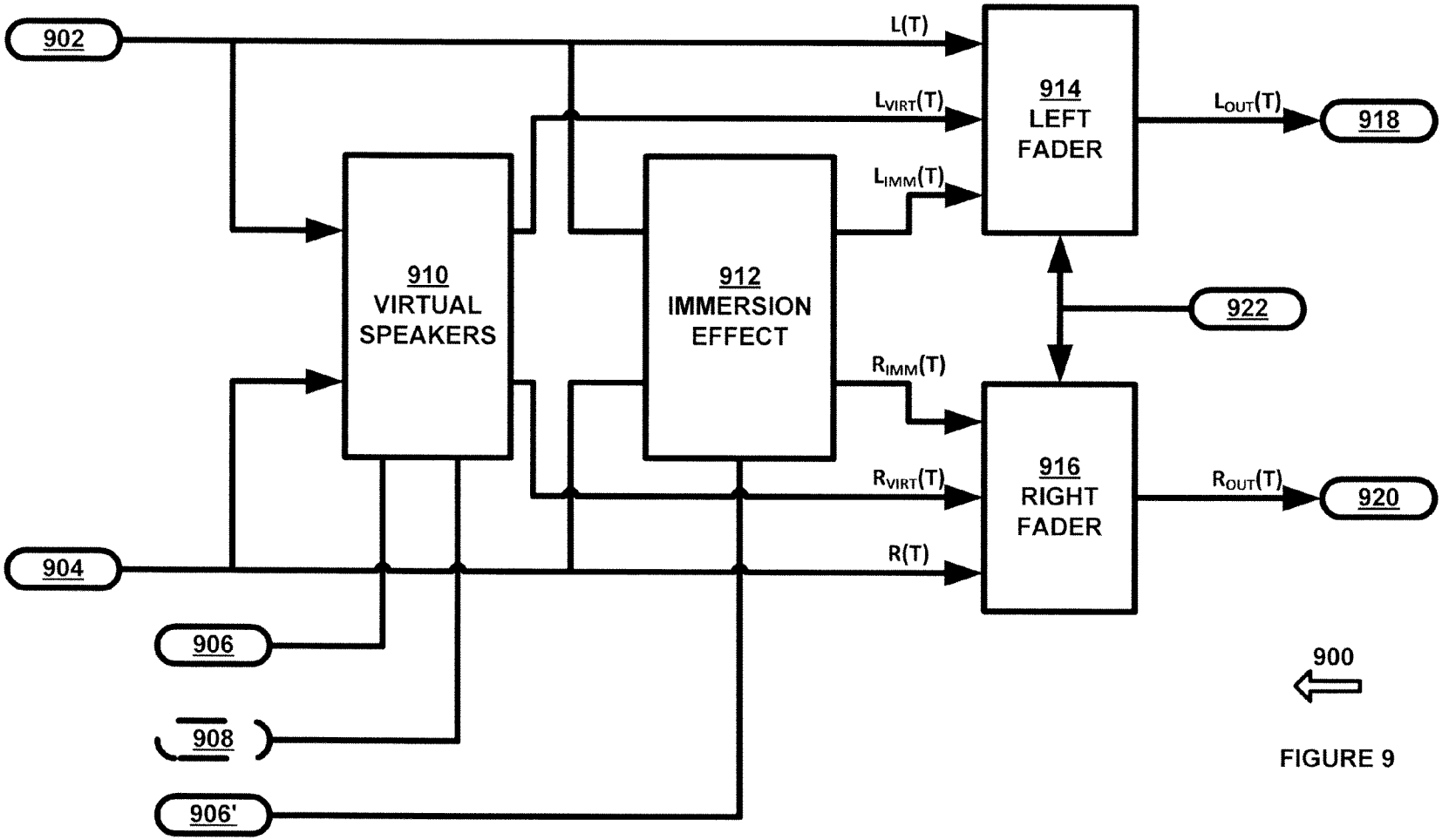
FIG. 9 is a diagram of a surround control system that can be used to provide speaker virtualization as well as an immersion effect.

FIG. 9 is a diagram of a surround control system 900 that can be used to provide speaker virtualization as well as an immersion effect. Surround control system 900 can be implemented in hardware or a suitable combination of hardware and software, and can be one or more software systems operating on a digital signal processing platform or other suitable processors.

Surround control system 900 comprises speaker virtualization system 700 and immersion effect system 800 which receives spread value 906'. Surround control system 900 can receive effects input 922 to allow a user to control whether to employ the speaker virtualization effect, the immersion effect or no effect. Left fader 914 facilitates a smooth transition between the different modes in the left channel and right fader 916 facilitates a smooth transition between the different modes in the right channel.

Various fader techniques can be employed within left fader 914 and right fader 916. In one exemplary embodiment, a three-way fader can be employed is a mixer where left audio output signal 918 can be expressed as $L_{OUT}(T)=A*L(T)+A_{IMM}*L_{IMM}(T)+A_{VIRT}*L_{VIRT}(T)$, where $L_{IMM}(T)$ is the left output audio signal of immersion effect system 800 and $L_{VIRT}(T)$ is the left output audio signal of speaker virtualization system 700. Likewise, right audio output signal 920 can be expressed as $R_{OUT}(T)=A*RL(T)+A_{IMM}*R_{IMM}(T)+A_{VIRT}*R_{VIRT}(T)$, where $R_{IMM}(T)$ is the right output audio signal of immersion effect system 800 and $R_{VIRT}(T)$ is the right output audio signal of speaker virtualization system 700. For both output signals, A, $A_{IMM}$ and $A_{VIRT}$ gain coefficients.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A sound reproduction apparatus comprising:

a loudspeaker bar having a plurality of loudspeakers;

a loudspeaker bar controller coupled to the loudspeaker bar for processing audio data for the plurality of loudspeakers, the loudspeaker bar controller having a left head related transfer function filter and a right head related transfer function filter, wherein the loudspeaker bar controller is configured to:

process a surround audio data channel with the left head related transfer function filter;

process the surround audio data channel with the right head related transfer function filter; and process a plurality of channels of audio data to widen a spatial image of the plurality of channels of audio data;

wherein a left stereo channel of audio data and a right stereo channel of audio data associated with the surround audio data channel are not processed with the head related transfer function filter.

2. The apparatus of claim 1, wherein the loudspeaker bar controller further has a cross cancellation system coupled to the left head related transfer function filter and the right head related transfer function filter, for cross cancelling common audio content from the left head related transfer function processed audio data and the right head related transfer function processed audio data.

3. The apparatus of claim 1 further comprising a surround system for receiving loudspeaker configuration data and modifying the audio data as a function of the loudspeaker configuration data.

4. The apparatus of claim 1 wherein the loudspeaker bar controller further has:

a second left head related transfer function filter for processing a second channel of audio data;

a second right head related transfer function filter for processing the second channel of audio data;

wherein the cross cancellation system is further coupled to the second left head related transfer function filter, and the second head related transfer function filter.

5. The apparatus of claim 1 further comprising a bass enhancement system for receiving loudspeaker frequency response data and generating bass harmonics with amplitudes as a function of the loudspeaker frequency response data to enhance a bass frequency signal.

6. The apparatus of claim 1 further comprising a center enhance system for receiving loudspeaker configuration data and modifying the audio data as a function of the loudspeaker configuration data to enhance a center audio channel.

7. The apparatus of claim 1 wherein the loudspeaker bar controller further has:

a second left head related transfer function filter for processing a second channel of audio data;

a second right head related transfer function filter for processing the second channel of audio data;

wherein the cross cancellation is further coupled to the second left head related transfer function filter, and the second head related transfer function filter, for cross cancelling common audio content from the left head related transfer function processed audio data and the right head related transfer function processed audio data, and for multiplexing the cross cancelled audio data with left front channel audio data and right front channel audio data.

8. The apparatus of claim 1 further comprising a user detector for detecting a location of a user and for modifying the audio data as a function of the location of the user.

9. The apparatus of claim 1 wherein the loudspeaker bar and the loudspeaker bar controller is integrated into a mobile system.

10. A method for processing audio data comprising:

processing a surround audio data channel with a left head related transfer function filter;

processing the surround audio data channel with a right head related transfer function filter; and processing a plurality of channels of audio data to widen a spatial image of the plurality of channels of audio data;

wherein a left stereo channel of audio data and a right stereo channel of audio data associated with the surround audio data channel are not processed with the head related transfer function filter.

11. The method of claim 10 wherein processing the surround audio data channel with the left head related transfer function filter comprises:

processing a right surround audio data channel with the left head related transfer function filter; and processing the right surround audio data channel with the right head related transfer function filter.

12. The method of claim 10 wherein processing the surround audio data channel with the left head related transfer function filter comprises:

processing a left surround audio data channel with the left head related transfer function filter; and processing the left surround audio data channel with the right head related transfer function filter.

13. The method of claim 10 wherein processing the surround audio data channel with the left head related transfer function filter comprises:

processing a right surround audio data channel with a first left head related transfer function filter;

processing the right surround audio data channel with a first right head related transfer function filter;

processing a left surround audio data channel with a second left head related transfer function filter; and processing the left surround audio data channel with a second right head related transfer function filter.

14. The method of claim 13 further comprising:

combining the left head related transfer function processed right surround channel audio data with the left head related transfer function processed left surround channel audio data to generate left filtered audio data;

combining the right head related transfer function processed left surround channel audio data with the right head related transfer function processed right surround channel audio data to generate right filtered audio data; and cross cancelling the left filtered audio data and the right filtered audio data.

15. The method of claim 10 further comprising:

detecting a location of a user; and modifying a time delay based on the detected location of the user.

16. The method of claim 10 further comprising enhancing a center audio channel based on a location of a plurality of loudspeakers in a sound bar.

17. The method of claim 10 further comprising enhancing a bass audio signal based on a frequency response of a loudspeaker and to minimize a peak displacement of the loudspeaker.

18. The method of claim 10 further comprising performing the processing steps in a mobile system.

19. The method of claim 10, wherein the method is performed using a loudspeaker bar controller having a combination of hardware and software.

20. A loudspeaker bar controller for driving a loudspeaker bar, the loudspeaker bar controller comprising:

a combination of hardware and software configured to:

process a surround audio data channel with a left head related transfer function filter;

process the surround audio data channel with a right head related transfer function filter; and process a plurality of channels of audio data to widen a spatial image of the plurality of channels of audio data;

wherein a left stereo channel of audio data and a right stereo channel of audio data associated with the surround audio data channel are not processed with the head related transfer function filter.

* * * * *